US005657636A

United States Patent [19]

Suggs

[11] Patent Number: 5,657,636

[45] Date of Patent: Aug. 19, 1997

[54] SUPPLY AIR GRILL CONDENSATION ELIMINATION METHOD AND APPARATUS

[76] Inventor: William G. Suggs, 17016 Elderberry Dr., Mont Verde, Fla. 32756

[21] Appl. No.: 595,247

[22] Filed: Feb. 1, 1996

[51] Int. Cl.[6] ..... F25D 21/00; F25B 49/00

[52] U.S. Cl. ..... 62/80; 62/176.1; 62/275

[58] Field of Search ..... 62/80, 176.1, 176.2, 62/248, 275; 236/44 R; 454/121

[56] References Cited

U.S. PATENT DOCUMENTS 4,127,765 11/1978 Heaney ..... 62/248

FOREIGN PATENT DOCUMENTS 6-159820 6/1994 Japan ..... 62/176.1

*Primary Examiner*—William E. Wayner
*Attorney, Agent, or Firm*—Dorothy S. Morse

[57] ABSTRACT

A method and apparatus for eliminating the accumulation of moisture condensation on air conditioning supply grills of concentric diffusers which involves the positioning of heat transfer tape around the perimeter of an air conditioning supply grill, a humidistat positioned within the return air duct of the air conditioning system, and a relay located in the electrical component compartment of the air conditioning system which is connected to the humidistat so that when the humidistat senses high levels of moisture in the return air, the relay will allow current to flow through the heat transfer tape for warming of the air conditioning supply grill and prevention of moisture condensation accumulation thereon. Applications may include, but are not limited to, use in commercial air conditioning systems having concentric diffusers.

20 Claims, 2 Drawing Sheets

SUPPLY AIR GRILL CONDENSATION ELIMINATION METHOD AND APPARATUS

BACKGROUND—FIELD OF INVENTION

This invention relates to condensation reducing methods and apparatus, specifically to a method and apparatus for eliminating the accumulation of condensation on the air conditioning supply grills of concentric diffusers wherein heat transfer tape is positioned around the perimeter of the air conditioning supply grill and a humidistat is positioned within a return air side of the air conditioning unit so that when the humidistat senses high levels of moisture in the return air, a relay connected to it will allow current to flow to the heat transfer tape for warming of the air conditioning supply grill and prevention of moisture condensation accumulation thereon. Applications may include, but are not limited to, use in commercial air conditioning systems having concentric diffusers.

BACKGROUND—DESCRIPTION OF PRIOR ART

Concentric diffusers are widely used in the commercial air conditioning systems of restaurants. Supply air is provided from the air conditioning unit through openings in the perimeter of a concentric diffuser, while return air is drawn back into the air conditioning unit through an opening in the central portion of the concentric diffuser. A single air conditioning supply grill covers both openings. Owners of commercial air conditioning systems with concentric diffusers have experienced problems resulting from the accumulation of condensation on the air conditioning supply grills of such systems. For example, puddles of water have been known to accumulate on the floor beneath some concentric diffusers. Also, ceiling tiles around some concentric diffusers have become so saturated with moisture that they have fallen from the ceiling. Falling ceiling tiles and puddles on the floor are both likely to cause injury to restaurant customers and employees. Since such injuries often result in lawsuits, the prevention of condensation on the air conditioning supply grills of concentric diffusers is a matter which has important financial considerations for some restaurant owners. Devices are known which attempt to solve condensation problems associated with air conditioning systems. Some devices attempt to prevent the formation of condensate, while others attempt to trap, drain, and/or evaporate condensate.

The invention disclosed in U.S. Pat. No. 4,083,198 to Dennis (1978) is one device attempting to eliminate problems associated with air conditioning condensate. The Dennis invention discloses a housing having a false floor which is large enough to enclose the expansion coil assembly and blower fans of an air conditioning system. Condensate is collected through the false floor in the Dennis invention and drained therefrom. Another such device is the invention disclosed in U.S. Pat. No. 4,107,939 to Bolton (1978) which discloses a two part reservoir for an air conditioning unit and a rotatable fan which circulates condensate within the reservoir to reduce pockets of cold air which could cause exterior condensation on the air conditioning unit evaporator. A third example is the invention disclosed in U.S. Pat. No. 5,271,237 to Popelka (1993) which discloses a system of drainage conduits leading to a tank to remove and carry away condensate from each zone of a multi-zone hydronic thermal distribution system. The prevention of condensate is addressed in U.S. Pat. No. 5,211,605 to Shiga (1995). The Shiga invention discloses an air conditioning diffuser assembly made out of inorganic fiber material which has been molded and cured with a binder. The inorganic fiber material gives the diffuser assembly a low thermal conductivity so as to prevent the accumulation of condensate on the diffuser assembly. Although replacement of an air conditioning supply grill with the Shiga invention may be cost effective in that it might prevent lawsuits which might otherwise result from falling ceiling tiles and puddles on the floor, use of the Shiga invention would involve replacement of the entire diffuser assembly which could be expensive. It is not known to have an invention for reducing or eliminating the accumulation of condensation on the air conditioning supply grills of concentric diffusers which involves the positioning of heat transfer tape around the perimeter of the air conditioning supply grill and a humidistat positioned within the return air side of the air conditioning unit so that when the humidistat senses higher levels of moisture in the return air, a relay connected to it will allow current to flow to the heat transfer tape for warming of the air conditioning supply grill and prevention of moisture accumulation upon it.

SUMMARY OF INVENTION—OBJECTS AND ADVANTAGES

It is the primary object of this invention to provide apparatus which will prevent the accumulation of condensation on the air conditioning supply grills of concentric diffusers. It is also an object of this invention to provide a method for preventing the accumulation of condensation on air conditioning supply grills which comprises the use of heat transfer tape positioned around the perimeter of the air conditioning supply grill and a humidistat positioned within the return air side of the air conditioning unit. A further object of this invention is to provide a method and apparatus which will eliminate the presence of puddles of water on the floor beneath concentric diffusers which result from the accumulation of condensation on air conditioning supply grills. It is also an object of this invention is to provide a method and apparatus which will eliminate the saturation and falling of ceiling tiles due to condensation formed on air conditioning supply grills of adjacent concentric diffusers.

As described herein, properly manufactured and installed on the air conditioning supply grill of a concentric diffuser, the present invention would provide a means for preventing the accumulation of condensation on the air conditioning supply grill. In the preferred embodiment, a quantity of heat transfer tape would be positioned around the perimeter of the air conditioning supply grill. A layer of foam insulation is then placed over the heat transfer tape to maximize the amount of heat directed toward the air conditioning supply grill. The heat transfer tape would be activated by a humidistat positioned within a return air side of the air conditioning unit, in combination with a relay connected to the humidistat and positioned within the electrical component compartment of the air conditioning system, so that when the humidistat sensed an increase in humidity in the return air duct, the relay would allow current to flow to heat transfer tape for warming of the air conditioning supply grill and prevention of moisture accumulation upon it.

The description herein provides preferred embodiments of the present invention but should not be construed as limiting the scope of the air conditioning supply grill condensation elimination invention. Variations in the width of the heat transfer tape, the type of insulation used, the positioning of the heat transfer tape and insulation relative to each other and to the air conditioning supply grill, the type of humidistat used, and the type of relay used, other than those shown and described herein, can be incorporated into the present invention. Thus the scope of the present invention should be determined by the appended claims and their legal equivalents, rather than the examples given.

DETAILED DESCRIPTION OF PREFERRED EMBODIMENTS

Figure 1:
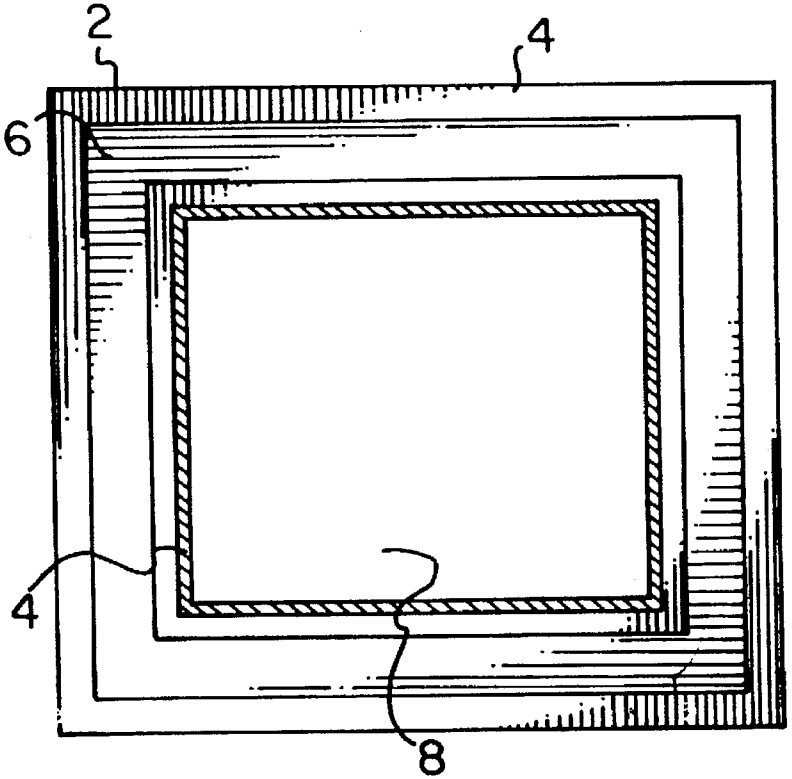
FIG. 1 is a top view of the invention insulation attached to an air conditioning supply grill.

FIG. 1 shows a preferred embodiment of present invention 2 attached to an air conditioning supply grill 4 which covers air duct openings in a concentric diffuser (not shown). In an air conditioning system using concentric diffusers, supply air is provided from the air conditioning unit (not shown) through air duct openings (not shown) in the perimeter of each concentric diffuser, while return air is drawn back into the air conditioning unit through a central opening, shown as number 8 in FIG. 1, in each concentric diffuser. FIG. 1 also shows insulation 6 attached to air conditioning supply grill 4. Although the type of insulation 6 used is not critical to present invention 2, in the preferred embodiment it is contemplated for insulation 6 to be a foam insulation tape.

Figure 2:
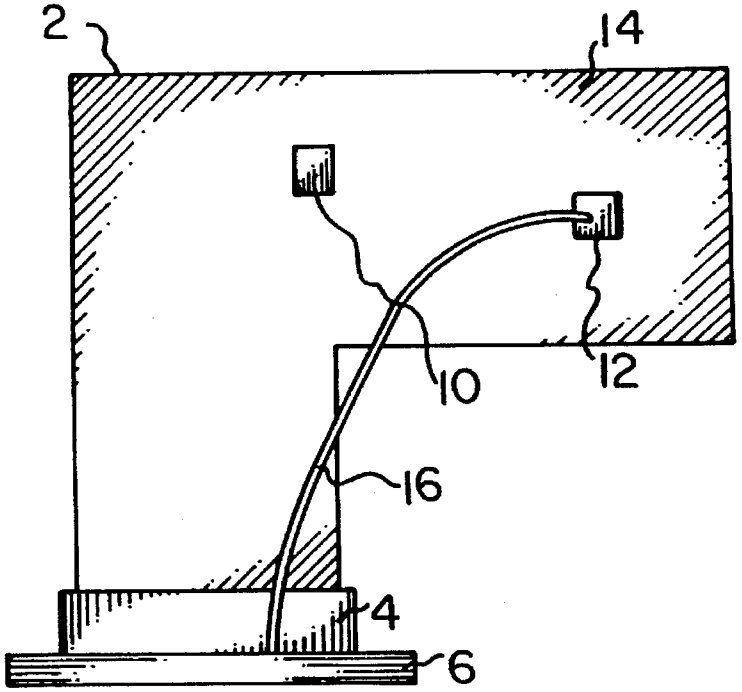
FIG. 2 is a side view of the invention having insulation, a humidistat, an anti-sweat relay, and electrical wire.
Figure 3:
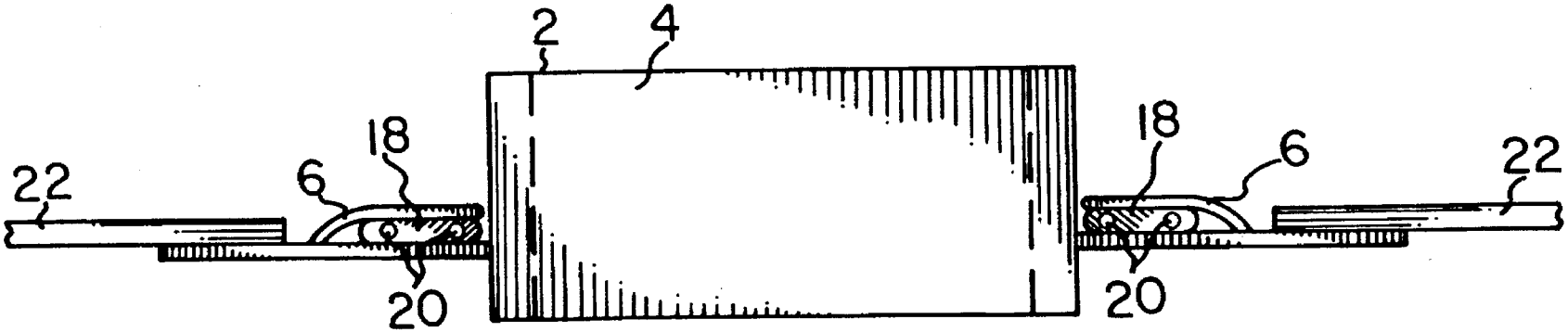
FIG. 3 is a sectional side view of the invention insulation and heat transfer tape attached to an air conditioning supply grill and positioned adjacent to ceiling tiles.

FIG. 2 shows a humidistat 10 positioned within the return air side of air ducting 14. Although the type of humidistat 10 used is not critical to present invention 2, in the preferred embodiment it is contemplated for humidistat 10 to be a conventional relative humidity sensor, such as the H69 humidistat manufactured by the Honeywell Corporation. Although not shown, humidistat 10 is connected to an anti-sweat relay 12, which in the preferred embodiment is located in an electrical component compartment of the air conditioning system and is part of a 24 volt secondary electrical circuit which is coupled to a 220 volt primary electrical circuit through a low voltage step-up transformer (not shown). In the preferred embodiment it is contemplated for anti-sweat relay 12 to be RBM type 75, number 90–230. The 24 volt secondary electrical circuit comprises humidistat 10 connected in series with anti-sweat relay 12, and further connected in series with the low voltage step-up transformer (not shown). The 220 volt primary electrical circuit comprises at least one anti-sweat relay 12 connected in series with an anti-sweat heater, such as a heat transfer tape 18, as shown in FIG. 3. Thus when humidistat 10 senses increased moisture (not shown) within the return air side of air ducting 14, humidistat 10 closes the 24 volt secondary circuit allowing current to flow through the 220 volt primary circuit to energize and activate heat transfer tape 18 to warm air conditioning supply grill 4 and prevent condensation from accumulating thereon. In the preferred embodiment, heat transfer tape 18 should have a power output of approximately 8 watts per foot when placed in a load of 240 volts at 40 degrees Fahrenheit.

FIG. 3 shows air conditioning supply grill 4 in a ceiling mounted position attached to two adjacent ceiling tiles 22. Heat transfer tape 18 is attached to air conditioning supply grill 4 and covered by insulation 6 to direct maximum heat output toward air conditioning supply grill 4. In the preferred embodiment it is contemplated for heat transfer tape 18 to be attached to the entire perimeter of air conditioning supply grill 4. FIG. 3 also shows heating wires 20 within heat transfer tape 18 which, when an electrical current (not shown) is allowed to flow therethrough, causes a warming of air conditioning supply grill 4 and prevention of moisture accumulation upon it.

What is claimed is:

1. Apparatus for preventing the accumulation of moisture condensation on an air conditioning supply grill of a concentric diffuser in an air conditioning system having a return air duct, said apparatus comprising at least one anti-sweat heater attached to said air conditioning supply grill; at least one humidistat positioned within said return air duct; at least one relay; and a quantity of electrical wiring connecting each of said humidistats to at least one of said anti-sweat relays so that when one of said humidistats senses an increased level of humidity in said return air duct, one of said relays may allow current to flow through said anti-sweat heaters for warming of said air conditioning supply grill and prevention of the accumulation of moisture condensation thereon.

2. The apparatus of claim 1 wherein said air conditioning supply grill has a perimeter and each of said anti-sweat heaters is positioned on said perimeter.

3. The apparatus of claim 1 wherein at least one of said anti-sweat heaters comprises a quantity of heat transfer tape.

4. The apparatus of claim 1 further comprising at least one quantity of insulation also attached to said air conditioning supply grill, each of said quantities of insulation covering at least one of said anti-sweat heaters so as to maximize direction of heat output from said anti-sweat heaters toward said air conditioning supply grill.

5. The apparatus of claim 4 wherein at least one of said quantities of insulation comprises foam insulating material.

6. The apparatus of claim 1 further comprising at least one anti-sweat relay electrically connected in series with said humidistat.

7. The apparatus of claim 6 further comprising said air conditioning system having an electrical component compartment and wherein each of said anti-sweat relays is located within said electrical component compartment.

8. The apparatus of claim 7 further comprising at least one 24 volt secondary electrical circuit located within said electrical component compartment, at least one 220 volt primary electrical circuit located within said electrical component compartment, and at least one low voltage step-up transformer located within said electrical component compartment and coupling one of said 24 volt secondary electrical circuits to one of said 220 volt primary electrical circuits, each of said 24 volt secondary electrical circuits comprising one of said humidistats connected in series with one of said anti-sweat relays, and further connected in series with one of said low voltage step-up transformers, each of said 220 volt primary electrical circuits comprising at least one of said anti-sweat relays connected in series with one of said anti-sweat heaters.

9. Apparatus for preventing the accumulation of moisture condensation on an air conditioning supply grill of a concentric diffuser in an air conditioning system having a return air duct and an electrical component compartment, said apparatus comprising at least one anti-sweat heater attached to said air conditioning supply grill; at least one quantity of insulation attached to said supply air grill, each of said quantities of insulation covering at least one of said anti-sweat heaters so as to maximize direction of heat output from said anti-sweat heaters toward said air conditioning supply grill; at least one humidistat positioned within said return air duct; at least one anti-sweat relay positioned within said electrical component compartment and electrically connected in series to said humidistat; a quantity of electrical wiring for electrically connecting each of said humidistats, to at least one of said relays, and to at least one of said anti-sweat heaters so that when at least one of said humidistats senses an increased level of humidity in said return air duct, one of said relays will allow current to flow through said anti-sweat heater for warming of said air conditioning supply grill and prevention of moisture condensation accumulation thereon.

10. The apparatus of claim 9 wherein said air conditioning supply grill has a perimeter and each of said anti-sweat heaters is positioned on said perimeter.

11. The apparatus of claim 9 wherein at least one of said anti-sweat heaters comprises a quantity of heat transfer tape.

12. The apparatus of claim 9 wherein at least one of said quantities of insulation comprises foam insulating material.

13. The apparatus of claim 9 further comprising at least one 24 volt secondary electrical circuit located within said electrical component compartment, at least one 220 volt primary electrical circuit located within said electrical component compartment, and at least one low voltage step-up transformer also located within said electrical component compartment and coupling one of said 24 volt secondary electrical circuits to one of said 220 volt primary electrical circuits, each of said 24 volt secondary electrical circuits comprising one of said humidistats connected in series with one of said anti-sweat relays, and further connected in series with one of said low voltage step-up transformers, each of said 220 volt primary electrical circuits comprising at least one of said anti-sweat relays connected in series with one of said anti-sweat heaters.

14. A method for preventing the accumulation of moisture condensation upon an air conditioning supply grill of a concentric diffuser in an air conditioning system having a return air duct, said method comprising the steps of providing at least one anti-sweat heater, at least one humidistat, and a quantity of electrical wiring; positioning each of said wiring; positioning each of said humidistats within said return air duct; positioning each of said anti-sweat heaters in contact with said air conditioning supply grill; connecting said quantity of electrical wiring between each of said humidistats, at least one of said anti-sweat relays, and at least one of said anti-sweat heaters so that when one of said humidistats senses an increased level of humidity in said return air duct, at least one of said anti-sweat relays will allow current to flow to at least one of said anti-sweat heaters for warming said air conditioning supply grill and prevention of moisture condensation accumulation thereon.

15. The method of claim 14 wherein said air conditioning supply grill has a perimeter and further providing the step of positioning each of said anti-sweat heaters on said perimeter.

16. The method of claim 14 wherein at least one of said anti-sweat heaters comprises a quantity of heat transfer tape.

17. The apparatus of claim 14 further providing the steps of providing at least one quantity of insulation, and attaching each of said quantities of insulation to said air conditioning supply grill so that each of said quantities of insulation covers at least one of said anti-sweat heaters so as to maximize direction of heat output from said anti-sweat heaters toward said air conditioning supply grill.

18. The method of claim 17 wherein at least one of said quantities of insulation comprises foam insulating material.

19. The method of claim 14 wherein said air conditioning system has an electrical component compartment and further comprising the steps of positioning each of said anti-sweat relays within said electrical component compartment, and electrically connecting each of said anti-sweat relays in series with at least one of said humidistats.

20. The method of claim 19 further comprising the step of providing at least one 24 volt secondary electrical circuit, at least one 220 volt primary electrical circuit, and at least one low voltage step-up transformer coupling at least one of said 24 volt secondary electrical circuits and one of said 220 volt primary electrical circuits, each of said 24 volt secondary circuits comprising one of said humidistats connected in series with one of said anti-sweat relays, and further connected in series with one of said low voltage step-up transformers, each of said 220 volt primary electrical circuits comprising at least one of said anti-sweat relays connected in series with one of said anti-sweat heaters, and further comprising the step of locating each of said 24 volt secondary electrical circuits, each of said 220 volt primary electrical circuits, and each of said low voltage step-up transformers within said electrical component compartment.

* * * * *